US005271778A

United States Patent [19]

Bradford et al.

[11] Patent Number: 5,271,778

[45] Date of Patent: Dec. 21, 1993

[54] CHLORINE-FREE SOLID ROCKET PROPELLANT FOR SPACE BOOSTERS

[75] Inventors: Daniel J. Bradford, Bountiful; John R. Goleniewski, Sandy, both of Utah

[73] Assignee: Hercules Incorporated, Wilmington, Del.

[21] Appl. No.: 816,357

[22] Filed: Dec. 27, 1991

[51] Int. Cl.[5] ..... C06B 45/10

[52] U.S. Cl. ..... 149/19.5; 149/19.4; 149/19.6; 149/20; 149/22

[58] Field of Search ..... 149/19.4, 19.5, 19.6, 149/20, 22

[56] References Cited

U.S. PATENT DOCUMENTS

| | | | |
|---|---|---|---|
| 3,350,245 | 10/1967 | Dickinson | 149/19 |
| 3,445,304 | 5/1969 | Cahill et al. | 149/19 |
| 3,873,386 | 3/1975 | Elrick | 149/19.2 |
| 4,158,583 | 6/1979 | Frosch | 149/19.4 |
| 4,165,247 | 8/1979 | Brew et al. | 149/19.4 |
| 4,318,270 | 3/1982 | Orlick et al. | 149/22 |
| 4,642,147 | 2/1987 | Hyyppä | 149/22 |
| 4,919,737 | 4/1990 | Biddle et al. | 149/19.5 |
| 4,925,909 | 5/1990 | Kubota et al. | 149/19.4 |
| 4,976,794 | 12/1990 | Biddle et al. | 149/19.5 |
| 5,074,938 | 12/1991 | Chi | 149/21 |
| 5,076,868 | 12/1991 | Doll et al. | 149/19.4 |

*Primary Examiner*—Edward A. Miller
*Attorney, Agent, or Firm*—John E. Crowe

[57] ABSTRACT

A stable chlorine-free solid rocket propellant composition containing a low energy binder component having an HEX value not exceeding about 0 cal/gm and comprising, in combination, a nitrate salt and/or phase stabilized nitrate salt as oxidizer component, a Mg/Al alloy of limited Mg content as a fuel component, at least one energetic plasticizer component, and a burn rate catalyst.

19 Claims, No Drawings

CHLORINE-FREE SOLID ROCKET PROPELLANT FOR SPACE BOOSTERS

This present invention relates to a class of thermally stable modified double based rocket propellant compositions of a chlorine-free type, utilizing inorganic nitrate-based salt(s) as an oxidizer component.

BACKGROUND

There are two main types of solid rocket propellants in present use, the double base type and the composite type. Because of serious and long standing problems involving the brittleness of double based propellants under low temperature conditions and their detonation characteristics, composite type propellants are favored for use in large rockets and rocket boosters.

Composite type propellants generally contain an inorganic oxidant and a fuel component incorporated into an elastomeric-type binder which is capable of being successfully cast and cured, in situ, while bonded to the inside of a rocket or booster casing. A high degree of reliability and precision in the geometry of the cast is necessary.

Because of their high burn rate, thermal stability plus high loading potential with conventional binders and plasticizers, inorganic perchlorate salt(s) such as ammonium perchlorate have been widely used as major oxidant components in many composite formulations. Such use, however, presents a serious problem due to the fact that the corresponding rocket exhaust includes a very high percentage (21%-22%) of hydrogen chloride, which constitutes both a health hazard and a serious environmental pollutant, particularly in higher atmospheric zones where convection is minimal or essentially non-existent.

As a result, continuing attempts are being made (ref Cahill et al U.S. Pat. No. 3,445,304 and Frosch et al U.S. Pat. No. 4,158,583) to wholly or partly substitute nitrate-based non-chlorine-containing salts in place of perchlorate salts as a primary oxidizer component. Such attempts have not been successful, thus far, (a) because of low or limited solids loading (b) difficulty in casting and curing the combined formulation, (a) a low burn rate with low combustion efficiency, and (d) potential thermal instability due to a rapid depletion of conventional stabilizers under moderate heat in the presence of various burn rate catalysts and metal fuel components.

It is an object of the present invention to obtain a solid propellant which does not evolve substantial amounts of hydrogen chloride in the firing exhaust.

It is a further object to obtain a stable, chlorine-free high-energy modified double based propellant composition of suitable burn rate and efficiency, which utilizes an inorganic nitrate salt as a major oxidizer component.

THE INVENTION

A rocket propellant satisfying the above objects is obtained by formulating a composition comprising, in combination A. a low energy binder component selected from at least one of a polyether-, or polyester- based polymer including copolymer(s) thereof, having a total heat of explosion (HEX)[1] not exceeding about 0 cal/gm.

[1] The energy obtained by burning under a nitrogen atmosphere and cooling (non-adiabatically) to ambient temperature.

For present purposes the term "low energy binder" is further conveniently defined as a total binder mixture having a HEX value within about −580 cal/gm. to about 0 cal/gm, the higher energy zone (i.e. about −195 cal/gm up to about 0 cal/gm) being most easily obtainable in a binder containing an effective amount of one or more high energy plasticizer(s) such as triethylene glycol dinitrate (TEGDN), 1,2,4-butanetriol trinitrate (BTTN), diethylene glycol dinetrate (DEGDN), trimethylethane trinitrate (TMETN), and nitroglycerine (NG).

Also included within the present invention is the use of binders having lower HEX energy values within a range extending from about −580 cal/gm to about −195 cal/gm. Such compositions are most readily obtainable by utilizing a less energetic plasticizer component such as a nitrato alkyl nitramine, inclusive of a methyl- ethyl-, propyl-, and butyl nitrato ethyl nitramine or combinations thereof with more energetic material. As above noted, the binder component preferably comprises (a) at least one energetic plasticizer component of at least one member selected from a nitrato alkyl nitramine, TEGDN, DEGDN, BTTN, TMETN and NG. Such plasticizers are preferably utilized in a concentration of about 8-15% by weight of propellant, the precise amount used, however, depends upon the choice of oxidizer component, the choice of polymeric material, the ratio of oxidizer-to-fuel (O/F), the choice and amount of burn rate catalyst used to augment the propellant burn rate, and ultimately, the desired HEX value of the plasticizer and propellant.

(b) An active amount of at least one nitrate-based oxidizer component comprising ammonium nitrate (AN) and/or phase-stabilized AN, in place of perchlorate salts as oxidizer components has heretofor been less than successful due to inherent low loading limitations, low energy content, and low burn rates (i.e. substantially less than about 0.2"/second) for the resulting propellant formulations.

For present purposes, "phase stabilized AN" is denotes the nitrate salt premixed with a metal oxide such as ZnO or NiO;

The term "active amount of nitrate-based phase stabilized oxidizer component," for present purposes assumes about 75-80% solids and a ratio of oxidizer component to fuel component within a range of about 1-2.5 parts to 1 part by weight;

B. The term "an active amount of a fuel component comprising a Mg/Al alloy" denotes an amount which is compatible with the above-described oxidizer component and also capable of increasing combustion efficiency and stability (compared with Mg alone).

For example, it is found that a Mg/Al alloy, in which the amount of elemental Mg does not substantially exceed about 50% by weight of the alloy (preferably about 20%-50%) and the amount of alloy component in the propellant formulation varies from about 15%-30%, or slightly higher, based on propellant weight, is compatible with an acceptable stabilizer depletion rate (see Table 1). In general, a stabilizer depletion rate sufficiently low to assure a stable propellant life of 30 days at 158° F. and 30 years at 77° F. is considered marginally acceptable.

While an increase in the ratio of oxidizer component to metal fuel (O/F) within a propellant of the present invention does not appear to be directly correlated to increased burn rate, it is found to affect combustion efficiency and pollution potential, as well as overall booster reserve capacity. For present purposes, a ratio of about 1.0–1.9/1 and preferably 1.2–1.9/1 (O/F) is found generally acceptable for binders falling within a HEX (energy) range of about −580 cal/gm to about 0 cal/gm or possibly slightly higher; and C. The term "an effective amount of a propellant burn rate catalyst" denotes an amount sufficient to assure a burn rate exceeding 0.20" and an optimal value of about 0.30"/second or higher. For present purposes it is normally necessary to include at least some compatible burn rate catalyst within the propellant. In the present instance "an effective amount" also constitutes a range of up to about 20% and preferably about 1–16% by weight of amorphous boron and/or amorphous boron/-$KNO_3$[2] to best assure a burn rate suitable for military or space purposes.

[2] $KNO_3$ (10%) phase stabilized AN.

Propellant compositions within the scope of the present invention also preferably include relatively small amounts of art-recognized additives inclusive of isocyanate and polyisocyanate curative agents such as Desmodur® N-100; catalyst activators such as maleic anhydride; stabilizers such as nitroaniline or alkyl derivatives thereof, curative catalysts such as triphenyl bismuth and the like.

The total amount of such art-recognized additives, however, generally do not exceed about 2% by propellant weight.

The present invention is further illustrated but not limited by the following examples and tables:

EXAMPLE I

Test batches of chlorine free phase-stabilized nitrate based propellant are prepared for conventional microwindow bomb and subscale motor testing procedures to ascertain the effect of (a) various Mg/Al alloys as fuel components, (b) variations in oxidizer/fuel ratios, and (c) effect of burn rate catalyst on ammonium nitrate based propellent burn rates.

A. Test propellants of different energy content utilizing different Mg/Al alloy ratios as fuel components are prepared in one pint amounts by admixing 12 parts of low molecular rate polyglycol adipate prepolymer (PGA) with 10.3 parts triethylene glycol dinitrate (TEGDN) energetic plasticizer[3] and 0.40 parts N-methyl-p nitroaniline 0.06 parts of DER® 331[4] for about 20 minutes at 120° F. To this mixture is then added ammonium nitrate (39.3 parts); after 15 minutes of mixing, 0.04 parts triethylene tetranitramine (TET) bonding agent are also added, and the mass agitated at 120° F. under vacuum for 30 minutes. To this mass is added 23.7 parts of magnesium/aluminum alloy[5] (325 mesh) of desired Mg content or ratio as fuel component, plus a fine mix of ammonium nitrate (13.1 parts). After 30 minutes of additional mixing under partial vacuum at 120° F., the mixer is vented and isocyanate curative agents and a curing catalyst are added as a premix comprising Isophorone diisocyanate (0.79 parts)
N 100 polyfunctional isocyanate (0.46 part)
Triphenyl bismuth catalyst (0.05 part)
Maleic anhydride (0.10 part);

then mixed under vacuum for an additional 30 minutes. The mass is cast into paper molds to obtain 600 gram and 6,000 gram test samples which are cured and then allowed to slowly cool to ambient temperature and stored. The samples are identified as TA-1, TA-2, TA-3, TA-4, TA-5, TA-6, TA-7, TA-8, TA-9 and TA-10.

[3] The amount being based on estimated HEX values of −580 cal/gm and −195 cal/gm.
[4] Dow Chemical Epoxy bonding agent.
[5] varying in % by weight of Mg/sample Test results are reported in Table 1 with respect to the effect of Mg content in the fuel, energy content, burn rate and stability.

TABLE 1

| Sample # | % Mg in Fuel Alloy | HEX Value of Binder cal/gm | Burn Rate (inches/sec) | Exotherms[6] temp °C. | 158° F. MNA %[7] Depletion Rate/day |
|---|---|---|---|---|---|
| TA-1 | 20 | −580 | .125 | NONE | — |
| TA-2 | 20 | −195 | .150 | NONE | 0.01 |
| TA-3 | 40 | −580 | .162 | NONE | — |
| TA-4 | 40 | −195 | .175 | NONE | 0.02 |
| TA-5 | 50 | −580 | .187 | — | — |
| TA-6 | 50 | −195 | .187 | 147° | 0.04 |
| TA-7 | 60 | −580 | .225 | — | — |
| TA-8 | 60 | −195 | .200 | 124° | 0.05 |
| TA-9 | 80 | −580 | .275 | — | — |
| TA-10 | 80 | −195 | .230 | 166° | 0.11 |

[6] Exotherms and significant stabilizer depletion rates noted at 158° F. for alloys exceeding about 50% Mg and HEX values of −195 or higher.
[7] Liquid chromatographic technique utilizing VARIAN/model 401/402 Data Station with silica gel column.

[6] Exotherms and significant stabilizer depletion rates noted at 158° F. for alloys exceeding about 50% Mg and HEX values of −195 or higher.
[7] Liquid chromatographic technique utilizing Varian/model 401/402 Data Station with silica gel column.

B. The test propellant of Example 1A is modified by utilizing only 23.7 parts of 40% Mg in the Mg/Al alloy fuel component and a −195 cal/gm binder HEX value but varying the weight ratio of phase-stabilized ammonium nitrate oxidizer-to-alloy (fuel) from 1.2–1.9 to 1. The resulting burn rates of the resulting propellants TB-11, TB-12, TB-13, and TB-14 are recorded in Table II below:

TABLE 2

| Sample (Av.) | Oxidizer/Fuel | Burn Rate (Inches/sec) |
|---|---|---|
| TB-11 | 1.25/1 | 0.170 |
| TB-12 | 1.50/1 | 0.190 |
| TB-13 | 1.80/1 | 0.190 |
| TB-14 | 1.90/1 | 0.170 |

EXAMPLE 1 -continued

C. Test propellants are prepared in the manner of Example 1A, but utilizing a 45/55 Mg/Al alloy, a HEX value of about −195 cal/gm and varying amounts (i.e. 2%, 6%, 8%, 10%, 12% and 16% by weight) of amorphous boron as burn rate catalyst with and without supplemental $KNO_3$/AN. The resulting propellant samples, identified respectively as TC-1, TC-2, TC-3, TC-4, TC-5, TC-6, TC-7, TC-8 and TC-9 are tested for burn rate in a micro bomb and the results reported in Table 3 below:

TABLE 3

| Sample # | % Amorphous Boron | Burn Rate (LPs) (Inches/Sec.) |
|---|---|---|
| TC-1 | 2 | 0.205 |
| TC-2 | 4 | 0.201<br>0.235 |
| TC-3 | 6 | 0.230<br>0.265 |
| TC-4 | 8 | 0.262<br>0.300 |
| TC-5 | 10 | 0.295<br>0.325 |
| TC-6 | 12 | 0.325<br>0.352 |
| TC-7 | 16 | 0.350<br>0.412 |
| TC-8 | 5 (with AN) | 0.415<br>0.230 |
| TC-9 | 5 (With $KNO_3$/Stab. AN) | —<br>0.400 |
| Control | 0 | —<br>0.175 |

EXAMPLE II

Propellant samples (HEX-195/gm) obtained in accordance with Example 1A and identified as TA-2, TA-4, TA-6, TA-8 and TA-10 are stored for a 24 hour period at 158° F. and 25% relative humidity. The samples are thereafter analyzed to determine the effect of Mg level on MNA (N-methyl p-nitroaniline) stabilizer depletion rate[7]. Test results are reported in Table 1 (last column).

We claim:

1. A stable solid rocket propellant composition comprising, in combination

A) a low energy binder component selected from the group consisting of a polyether- and polyester-, based polymer or copolymer(s) having a total heat of explosion (HEX) not exceeding about 0 cal/gm and comprising (a) at least one energetic plasticizer component of at least one member selected from the group consisting of a nitrato alkyl nitramine, TEGDN, DEGDN, BTTN, TMETN, and NG;

(b) an active amount of at least one nitrate-based oxidizer component comprising ammonium nitrate (AN) and/or phase-stabilized AN;

B) an active amount of a fuel component comprising an Al/Mg alloy, wherein Mg does not substantially exceed about 50% by weight of said alloy; and C) an effective amount of at least one propellant burn rate catalyst selected from the group consisting of amorphous boron and an amorphous boron/$KNO_3$ admixture.

2. A propellant composition of claim 1 wherein the ratio of oxidizer component to fuel component is within a range of about 1-2.5 to 1.

3. A propellant composition of claim 1 wherein the binder component comprises a polyglycol adipate.

4. A propellant composition of claim 1 wherein the energetic plasticizer component comprises (TMETN) and the binder HEX value is within the range of about −195 cal/gm to about 0 cal/gm.

5. A propellant composition of claim 1 wherein the energetic plasticizer component comprises nitroglycerine (NG) and the HEX value is within the range of about −195 cal/gm to about 0 cal/gm.

6. A propellant composition of claim 1 wherein the energetic plasticizer component comprises (DEGDN) and the binder HEX value is within a range of about −195 cal/gm to about 0 cal/gm.

7. A propellant composition of claim 1 wherein the energetic plasticizer component comprises (BTTN) and the binder HEX value is within a range of about −195 cal/gm to about 0 cal/gm.

8. A propellant composition of claim 1 wherein the energetic plasticizer component comprises (TMETN) and the binder HEX value is within a range of about −195 cal/gm to about 0 cal/gm.

9. A propellant composition of claim 1 wherein the energetic plasticizer component comprises a nitrato alkyl nitramine and the HEX value is within the range of about −580 cal/gm to about −195 cal/gm.

10. A propellant composition of claim 1 wherein the fuel component comprises about 20%-50% magnesium by weight of alloy, and the burn rate catalyst component comprises about 1%-16% by weight of amorphous boron and/or amorphous boron/potassium nitrate.

11. A propellant composition of claim 1, wherein the ratio of oxidizer component to fuel component is about 1.0-1.9 to 1.

12. In a method for increasing burn rate and efficiency while maintaining thermal stability of solid propellant composition containing A) a polyether-, or polyester-, based polymeric binder component comprising (a) at least one energetic plasticizer component and (b) at least one inorganic nitrate salt as oxidizer component;

B) a fuel component containing aluminum and magnesium; and

C) at least one burn rate catalyst;

the improvement comprising formulating a binder mass wherein the choice and amount of energetic plasticizer and fuel component admixed therein is commensurate with a propellant HEX value not exceeding about 0 cal/gm, wherein the oxidizer component is ammonium nitrate (AN) and/or phase stabilized AN; wherein the fuel component is a Mg/Al alloy containing up to about 50 wt. % Mg; and wherein the burn rate catalyst is amorphous boron and/or amorphous boron/$KNO_3$ utilized in an amount up to about 20% by weight of propellant.

13. The method of claim 12 wherein the propellant HEX value is within a range of about −195 cal/gm to about 0 cal/gm.

14. The method of claim 12 wherein the propellant HEX value is within a range of about −580 cal/gm to about −195 cal/gm.

15. The method of claim 12 wherein the ratio of oxidizer component-to-fuel component is within a range of about 1-2.5 to 1.

16. The method of claim 12 wherein the ratio of oxidizer component-to-fuel component is within a range of 1.2-1.9 to 1.

17. The method of claim 12 wherein the polymeric binder comprises a polyglycol adipate.

18. The method of claim 13 wherein the plasticizer component comprises a member selected from the group consisting of NG, DEGDN, BTTN and TMETN.

19. The methoid of claim 14 wherein the plasticizer component comprises a member selected from the group consisting of a nitrato alkyl nitramine and TEGDN.

* * * * *